US007584522B1

(12) United States Patent
Weeter et al.

(10) Patent No.: US 7,584,522 B1
(45) Date of Patent: Sep. 8, 2009

(54) VERTICAL CYCLONIC VACUUM ASSEMBLY

(75) Inventors: Darrell Weeter, Broadview Heights, OH (US); Wesley Schroeder, Akron, OH (US); Benjamin Scholles, Akron, OH (US)

(73) Assignee: F.V.S., Inc., Broadview Heights, OH (US)

( * ) Notice: Subject to any disclaimer, the term of this patent is extended or adjusted under 35 U.S.C. 154(b) by 185 days.

(21) Appl. No.: 11/705,692

(22) Filed: Feb. 14, 2007

(51) Int. Cl.
*A47L 9/10* (2006.01)
*A47L 9/16* (2006.01)
*A47L 9/32* (2006.01)

(52) U.S. Cl. ..... 15/350; 15/353; 15/410; 15/327.6; 15/412; 15/347; 55/429; 55/459.1; 55/DIG. 3

(58) Field of Classification Search ..... 15/329, 15/350, 353, 410, 327.6, 351, 412, 347; 55/DIG. 10, 55/DIG. 3, 429, 428, 459.1
See application file for complete search history.

(56) References Cited

U.S. PATENT DOCUMENTS 5,309,600 A 5/1994 Weaver et al.
5,524,321 A * 6/1996 Weaver et al. ..... 15/329
6,146,434 A 11/2000 Scalfini et al.
6,596,044 B1 7/2003 Bilek et al.
6,857,164 B2 2/2005 Bair et al.
6,902,596 B2 * 6/2005 Conrad et al. ..... 55/459.1
6,944,909 B2 9/2005 Bair et al.
7,047,594 B2 5/2006 Inoue
7,065,826 B1 6/2006 Arnold
7,069,620 B2 7/2006 Bagwell
7,100,234 B2 9/2006 Weber et al.
7,188,388 B2 * 3/2007 Best et al. ..... 15/329
2006/0000195 A1 1/2006 Lim et al.
2006/0174597 A1 8/2006 Greene

* cited by examiner

*Primary Examiner*—Gary K Graham
(74) *Attorney, Agent, or Firm*—John D. Gugliotta, PE, Esq.

(57) ABSTRACT

The present invention relates to a cyclonic vacuum cleaner and, more specifically, to a cyclonic vacuum cleaner having a cyclonic station that maintains a vertical position when the vacuum is maneuvered across a floor space. The instant abstract is neither intended to define the invention disclosed in this specification nor intended to limit the scope of the invention in any way.

11 Claims, 12 Drawing Sheets

VERTICAL CYCLONIC VACUUM ASSEMBLY

RELATED APPLICATIONS

Not Applicable.

BACKGROUND OF THE INVENTION

1. Field of the Invention

The present invention relates to a cyclonic vacuum cleaner and, more specifically, to a cyclonic vacuum cleaner having a cyclonic station that maintains a vertical position when the vacuum is maneuvered across a floor space.

2. Description of the Related Art

In the last decade, the convenience of bagless dust collection and emptying has made cyclonic vacuum cleaners the most successful ones marketed because they don't require consumers to purchase replacement bags. The method of removing particles from the air by means of cyclonic separation is well known in the art and, furthermore, its known uses, in combination with filters, have improved the design, the quality and the efficiency of vacuum cleaners. The present invention improves on the cyclonic design by constructing a cyclonic station that always maintains a complete, vertical position when the vacuum is pushed and maneuvered across a floor space. As is well known in the art, there are a number of vertical standing and upright vacuums having cyclonic air flows. A search of the prior art did not disclose any patents that read directly on the claims of the present invention; however, the following references were considered related.

Of considerable relevance is the cyclonic dirt cup assembly disclosed in U.S. Pat. No. 6,146,434, wherein an inverted, truncated cone positioned within the dirt cup of a vacuum cleaner directs an airstream in a cyclonic manner. Tapered walls assist the cyclonic action.

The cyclonic vacuum cleaner of U.S. Pat. No. 7,047,594 to Inoue discloses an approximate cylinder shaped cyclonic portion comprised in a dust collecting portion having two ventilating holes to always ensure a vortex flow.

U.S. Pat. No. 6,596,044 to Bilek et al. discloses a dirt collecting system for a vacuum cleaner comprising two dirt collecting chambers separated by apertured walls wherein course particles are pre-filtered into the first chamber and fine particles are filtered into the second chamber.

The upright vacuum cleaner with cyclonic air flow taught in U.S. Pat. No. 6,857,164 comprises a suction source that pulls air into a cyclonic air flow chamber. The airstream travels in a cyclonic path so contaminates are separated into a dirt container. A main filter filters residual contaminants and a final filter assembly filters the suction airstream discharged from the source.

These and many other vacuum cleaners comprise stand-up cyclonic dirt assembly portions; however, a disadvantage to all of their designs is that the handle portion is attached to these cyclonic portions. Therefore, when a person pushes and pulls the vacuum cleaner across a floor space, the cyclonic portion also changes angles with the handle from an approximate vertical position to a near horizontal position. The vacuum becomes less efficient as it is pushed into the horizontal position.

The movement of air in the dirt assembly is vortical or solenoidal. The rotational effects are used to separate particles in a cyclonic rotation process. As air flows through the cyclone, it rotates about an axis. The larger particles that have too much inertia follow the tight curve, strike the outside wall and fall due to gravity. Centripetal acceleration separates substances of larger and smaller densities because particles moving in the cylinder at a constant speed have changing directions and motion.

The centripetal force is affected by the mass of an object, the velocity (squared) its traveling and the distance its traveling about an axis. Although the effects of velocity and gravity are almost negligible for minute particles, they both affect the separation of larger particles. In a mostly vertical position, the velocity (vectors) of the particles traveling around the axis of the dust assembly is increasing because the particles are always falling with gravity as well as moving in a curved, downwards direction. When vacuums are pushed towards a more horizontal position, the angular velocity fluctuates because the particle falls with gravity and climbs against gravity around the horizontal axis of the air flow. The amount of inertia, or the particle's momentum, is constantly changing with the changing velocity.

A particle's momentum is directly related to its mass and its velocity. Therefore, fewer particles will strike the outside wall if the inertia is constantly changing. Because the efficiency of a vacuum is decreased in the more horizontal positions during the cleaning process, a long-felt need exists for a vacuum cleaner that provides for a constant or an increasing velocity in the cyclonic portion so that the increased acceleration can separate a greater number of particles having a greater number of densities. This need is met in the present invention, wherein the suction channel, the handle and the other portions of the vacuum cleaner are affixed to one another while the dirt assembly portion is pivotally affixed to the other components so that it will always maintain a vertical position.

SUMMARY OF THE INVENTION

It is therefore an object of the present invention to provide an improved cyclonic vacuum cleaner and, more particularly, one that increases the efficiency of collection.

It is an object of the present invention to design and construct a vacuum cleaner having a cyclonic dirt assembly that maintains a vertical, upright position even when the vacuum is pushed and maneuvered to a nearly horizontal position.

It is an advantage to the present invention to improve the number of particles captured in the cyclonic separation by means of maintaining or increasing the centripetal acceleration used to separate particles of a greater number of densities.

It is an advantage to the present invention to provide a means for the velocity to not fluctuate. The velocity rather increases because the direction is not repeatedly changing and the speed increases as the particle falls with gravity.

It is a further advantage to the present invention that more particles will have too much inertia such that they will more quickly follow the tight curve of the dirt assembly and be forced to strike the side walls and fall.

It is an object of this invention to accomplish these advantages by means of designing the dirt assembly portion of the cyclonic vacuum to pivotally attach to the handle, the suction and the other portions of the vacuum. It is envisioned that a person vacuuming will push and pull the vacuum across a floor space, but the very design and the construction of the dirt assembly will cause it to maintain a vertical position.

It is envisioned that the preferred embodiment will comprise an additional filter assembly having a plurality of filters placed in the vacuum to further ensure a greater entrapment of particles. It is a further object of the present invention to provide a simple and an efficient means to clean the dirt assembly and empty the particles contained within it. This is accomplished through dirt collection assembly portion that opens by means of a handle wherein the container held within can be easily pulled out and emptied. The dirt collection assembly forms a receptacle that cannot be removed unless a lock placed above it is flipped to disengage the container sealed in a secure position within the cyclonic portion.

It is an advantage to the present invention to comprise the vacuum with a moving bumper that opens a slot to collect dust at the base boards or the edges of the furniture that are typically difficult to reach. It is envisioned that the moving bumper is a nylon or a nylon overmolded with a rubber surface. The bumper will not scratch or dent the woods or the furniture it bumps.

It is another advantage to the present invention that the brushroll sleeves can be easily pulled out for cleaning or disposal. It is envisioned that either reusable or durable, inexpensive, disposable sleeves can be utilized.

It is another advantage to the present invention to design a handle that folds downwards when the vacuum is not utilized so that it will not occupy the entire storage space, but rather, it will only occupy the lower space of a closet.

A final advantage to the present invention is its light weight construction and design.

In an alternate embodiment to the present invention, it is envisioned that a user can lock the dirt assembly portion to the handle portion so that the dirt assembly will fall to a horizontal position when the user wants the vacuum to reach deep spaces, i.e. those spaces under furniture.

BRIEF DESCRIPTION OF THE DRAWINGS

The advantages and the features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

DETAILED DESCRIPTION OF THE FIGURES

Figure 1:
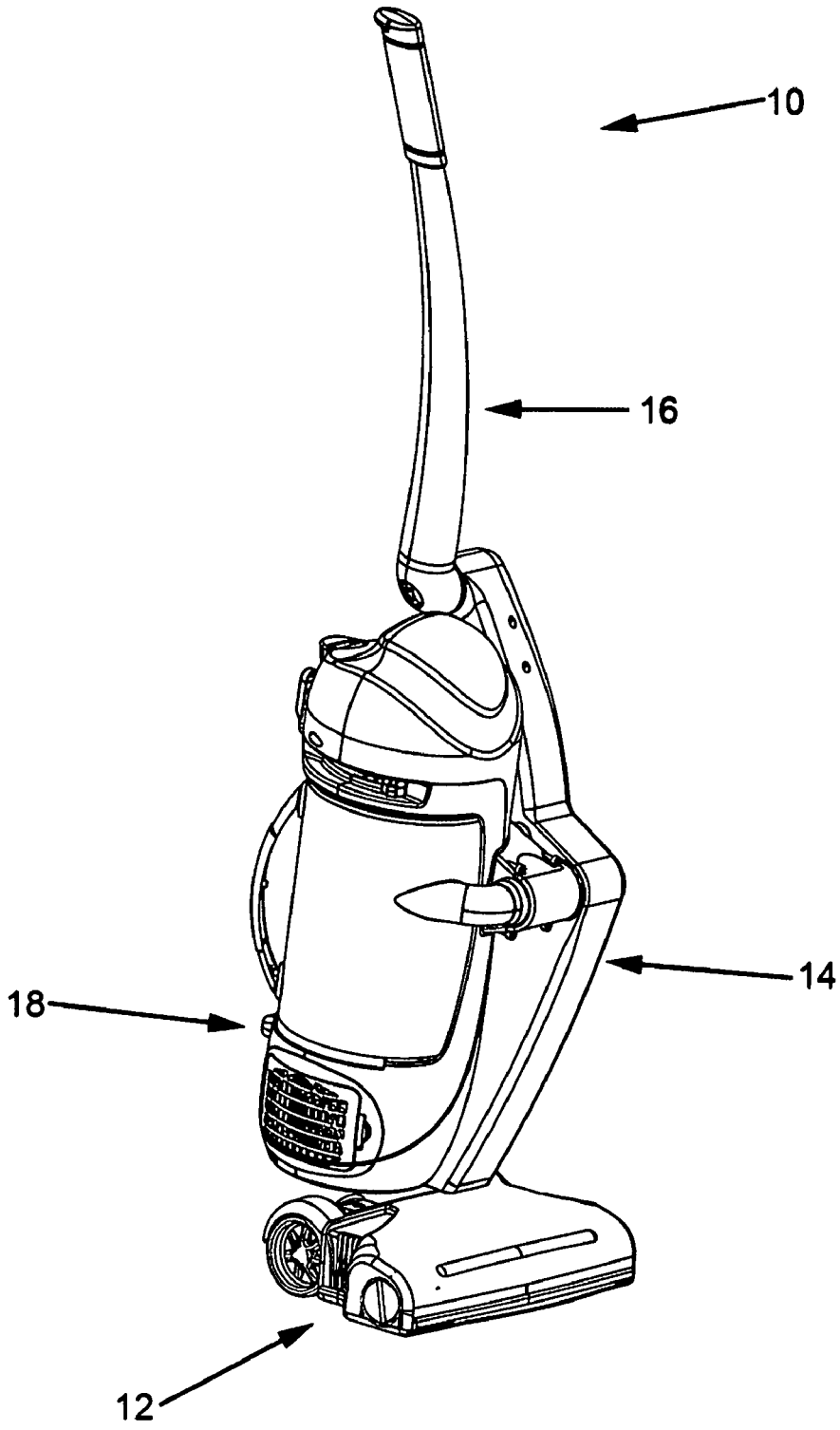
FIG. 1 is a perspective view of the vertical cyclonic vacuum according to the preferred embodiment of the present invention.
Figure 2:
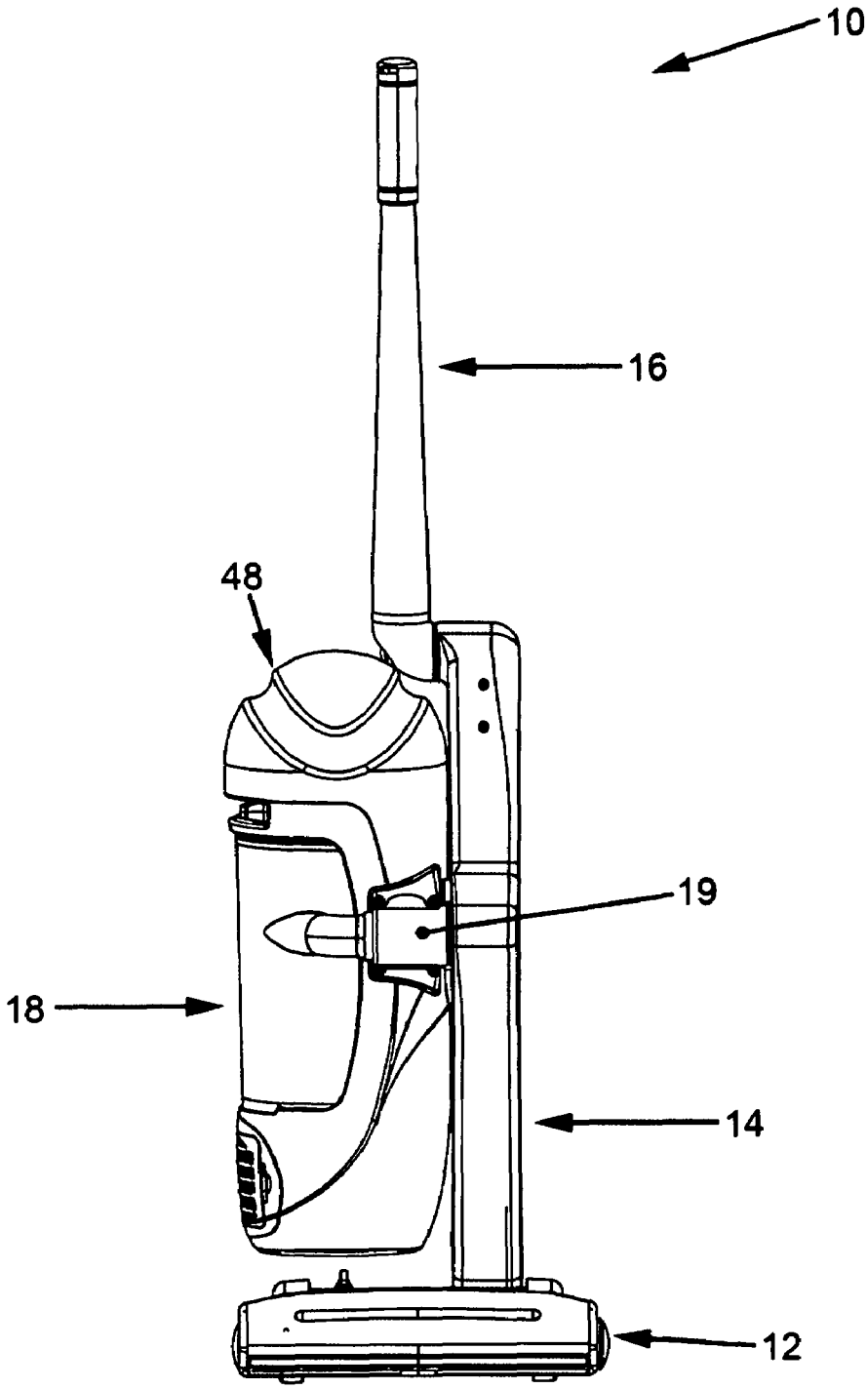
FIG. 2 is a front elevational view of vacuum shown in FIG. 1.
Figure 3:
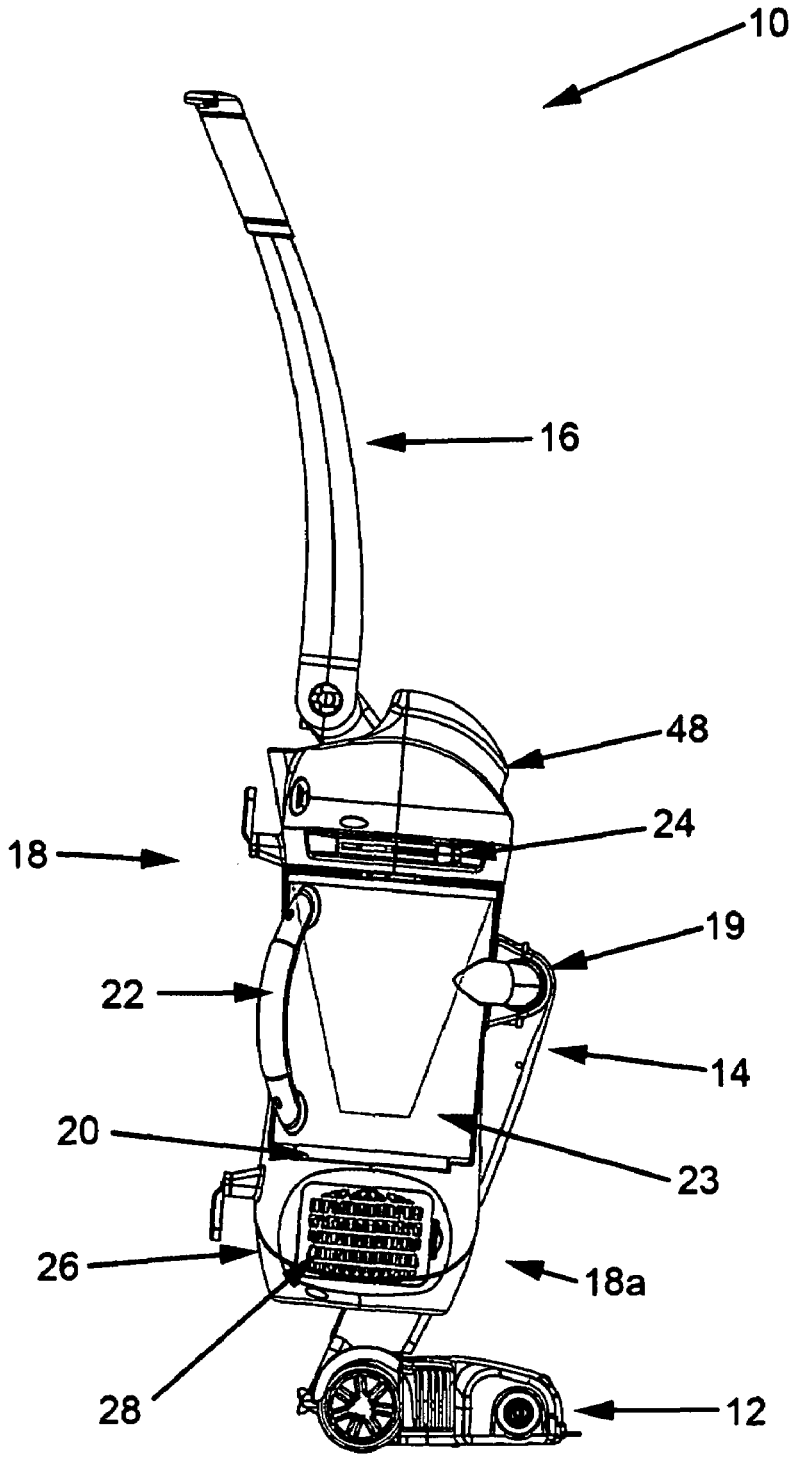
FIG. 3 is a right side elevational view of the vacuum, wherein the suspended cyclonic dirt assembly portion is shown.

Referring now to FIG. 1, a vertical cyclonic vacuum assembly, generally noted as 10, is shown according to the preferred embodiment of the present invention. The vacuum assembly 10 comprises a power brush (herein synonymously referred to as a power foot) 12 at a lower end and opposite a handle 16 at an upper end. Both the power foot 12 and the handle 16 are attached to a frame 14. A cyclonic assembly 18 is pivotally attached to the frame 14 such as to maintain a vertical configuration at the handle 16 is articulated upward or downward in a manner described in greater detail below. As shown in conjunction with FIG. 2, the front of the vacuum 10 shown wherein the cyclonic assembly 18 is pivotally attached to the frame 14 at their approximate center body portions about an axis 19. As can be better seen in conjunction with FIG. 3, the cyclonic assembly 18 is suspended above the power brush 12 and below the handle 16 portion of the vacuum 10 about the axis 19. The body 18*a* of the cyclonic portion 18 forms a dirt collection assembly 20 for access to a collection receptacle or container 23 for emptying the particles vacuumed from the floor. The container 23 cannot be removed unless a lock 24 placed above it is positioned to disengage the container 23 which is sealed in a secure position within the cyclonic assembly 18. The body 18*a* of the cyclonic assembly 18 also comprises a filter cage 26 provided with a pivotally mounted gate 28 for access to the filters that filter the airstream discharged from the vacuum cleaner 10.

Figure 4:
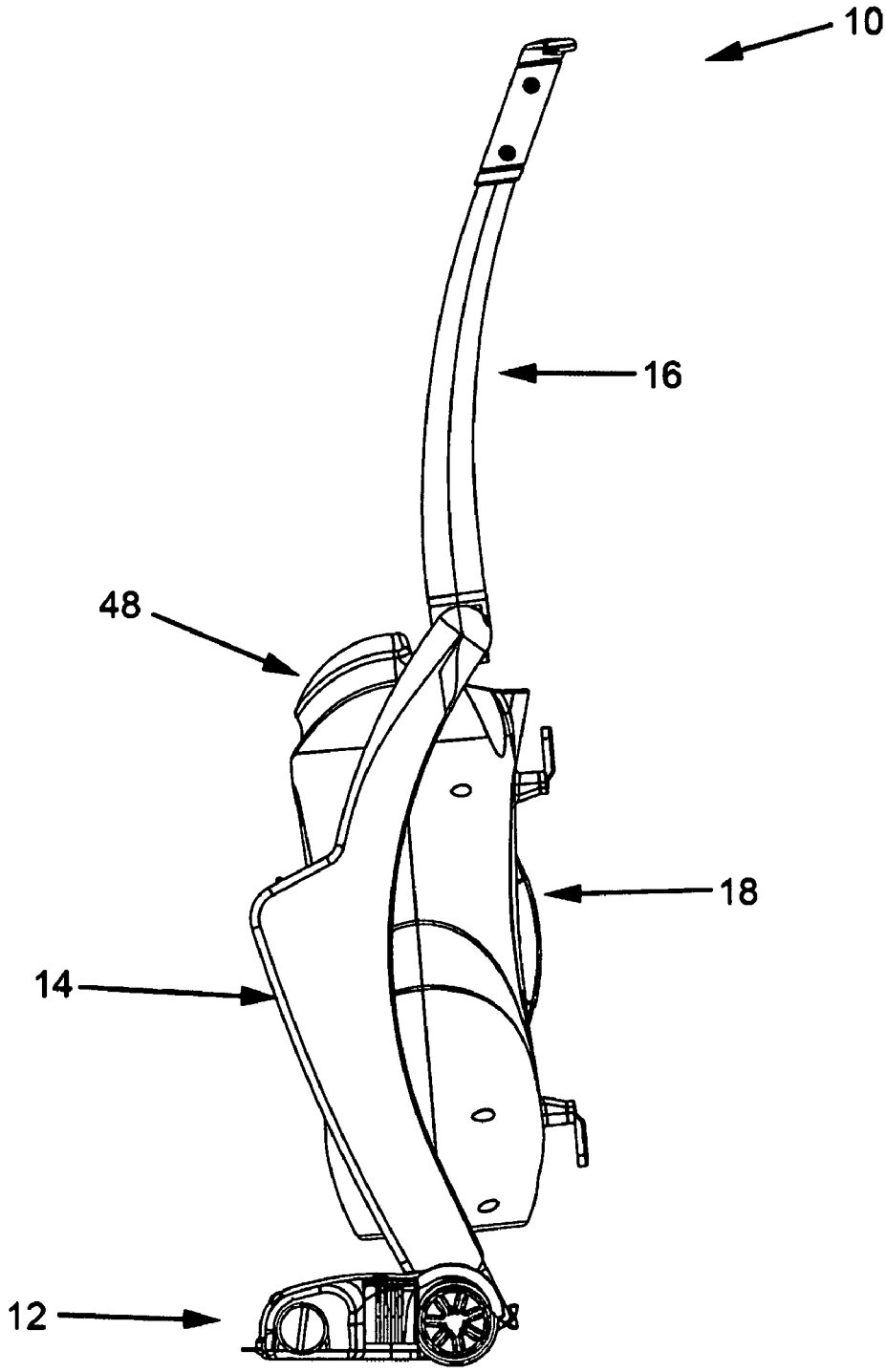
FIG. 4 is a left side elevational view of the vacuum, wherein the opposite side shown in FIG. 3 is shown.
Figure 5:
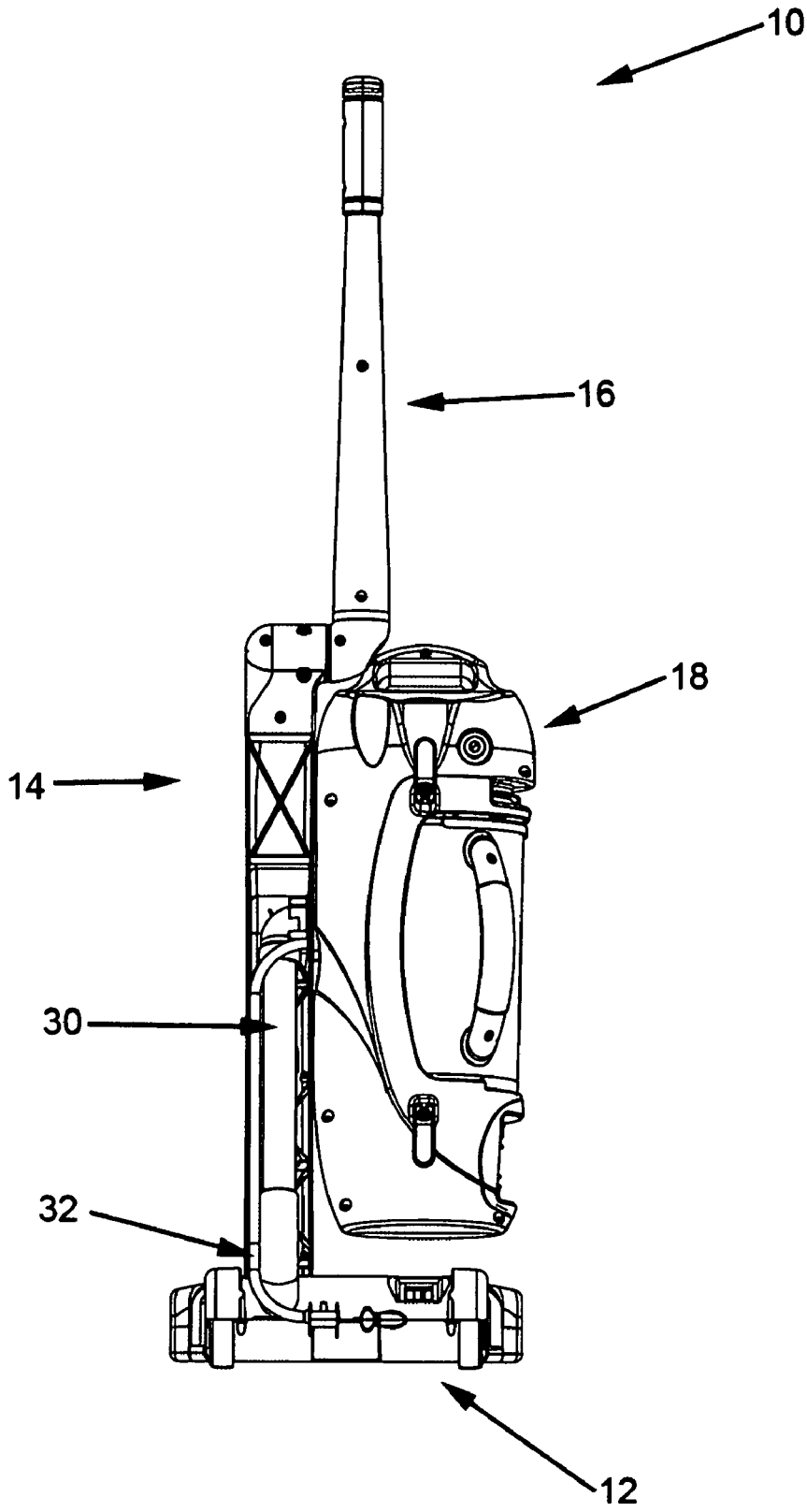
FIG. 5 is a rear elevational view of the vacuum.

Referring to FIG. 4, the side opposite the cyclonic portion 18 is shown in which the frame 14 is designed and constructed to balance the distribution of the vacuum 10 is shown in FIG. 5, wherein the disturbed dust is carried from the floor to the cyclonic portion 18 by means of a suction intake hose 30 positioned inside the greater portion of the backside of the frame 14. A power cord 32 similarly travels from the power brush 12 to the cyclonic portion 18.

Figure 6:
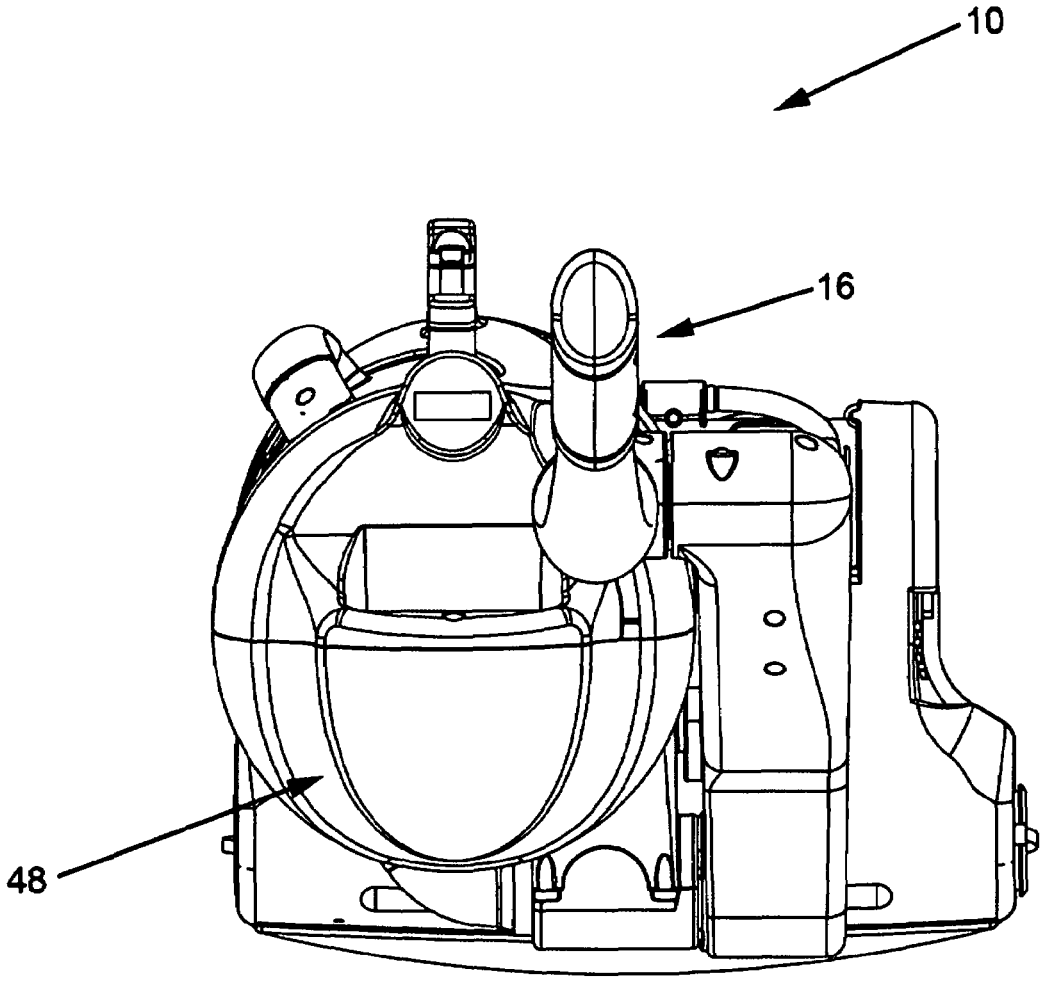
FIG. 6 is a top plan view of the vacuum.
Figure 7:
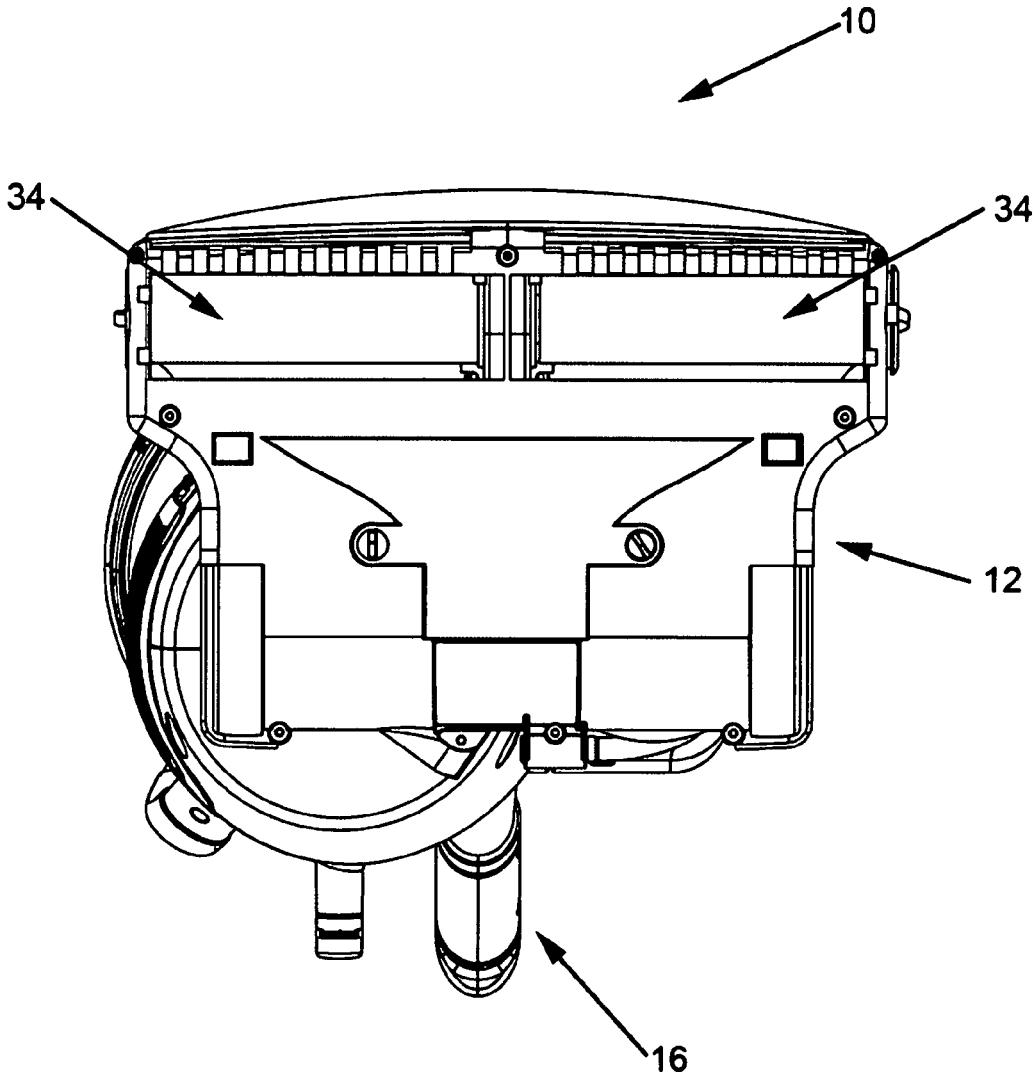
FIG. 7 is a bottom plan view of the vacuum.

A top view of the vacuum 10 is shown in FIG. 6, wherein the vacuum is standing in a fully upright position. The forward position of the handle 16 provides for a greater pivot range when the vacuum is pushed in a cleaning motion. The bottom portion of the vacuum 10 is shown in FIG. 7, wherein two rotating brushrolls 34 similar to those in many electrical, upright vacuums is the means to disturb the dust that is vacuumed up.

Figure 8:
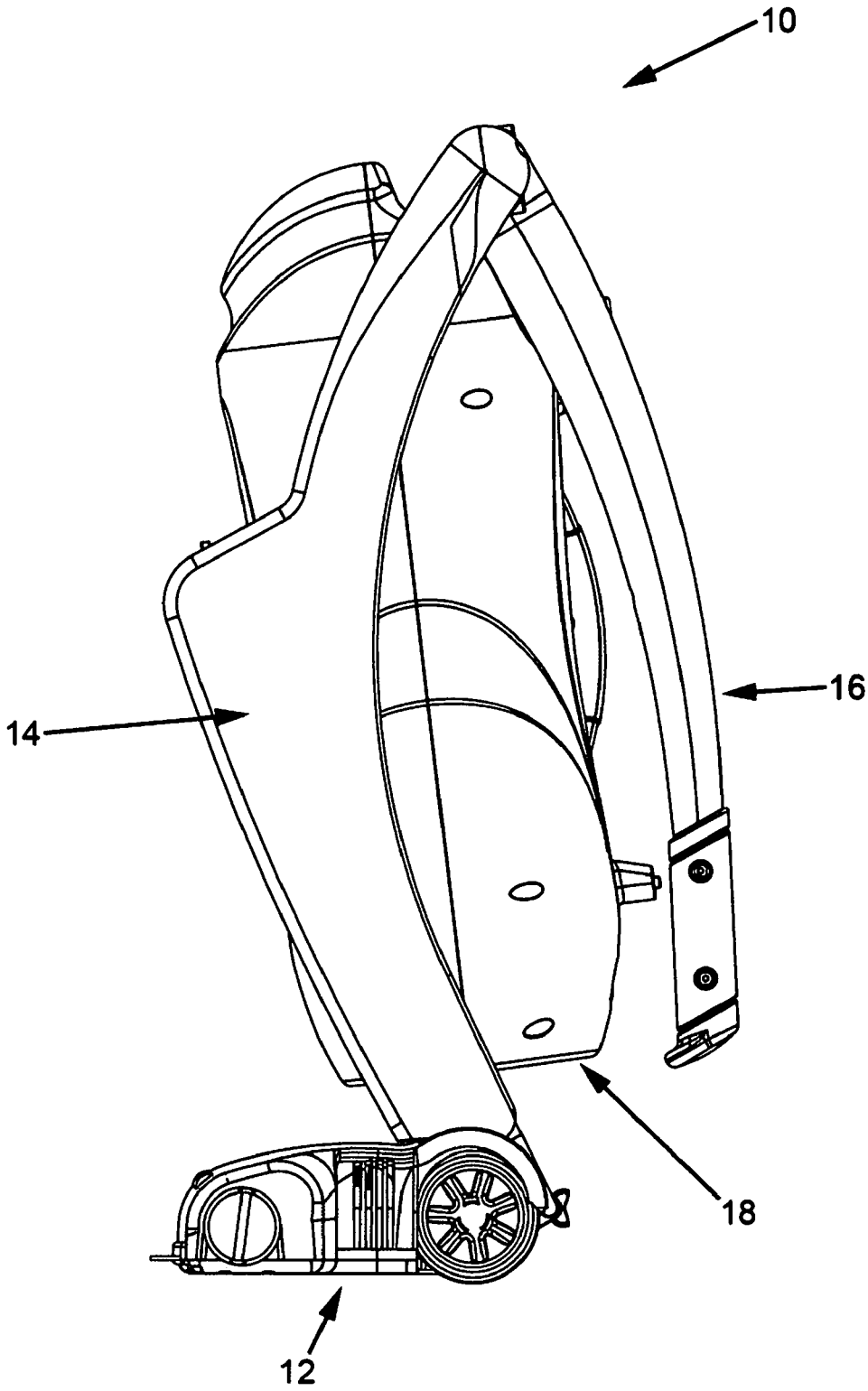
FIG. 8 is a side elevational view of the vacuum shown in FIG. 4, wherein the handle is pivotally folded downwards into a storage position.

The vacuum is shown in the storage position in FIG. 8, wherein the handle 16 that is pivotally attached to the top portion of the frame 14 is folded downwards when the vacuum 10 is not utilized. An advantage to this design is that the vacuum will only occupy the lower half of the closet space its stored in and thus it will not disrupt any hanging garments.

Figure 9:
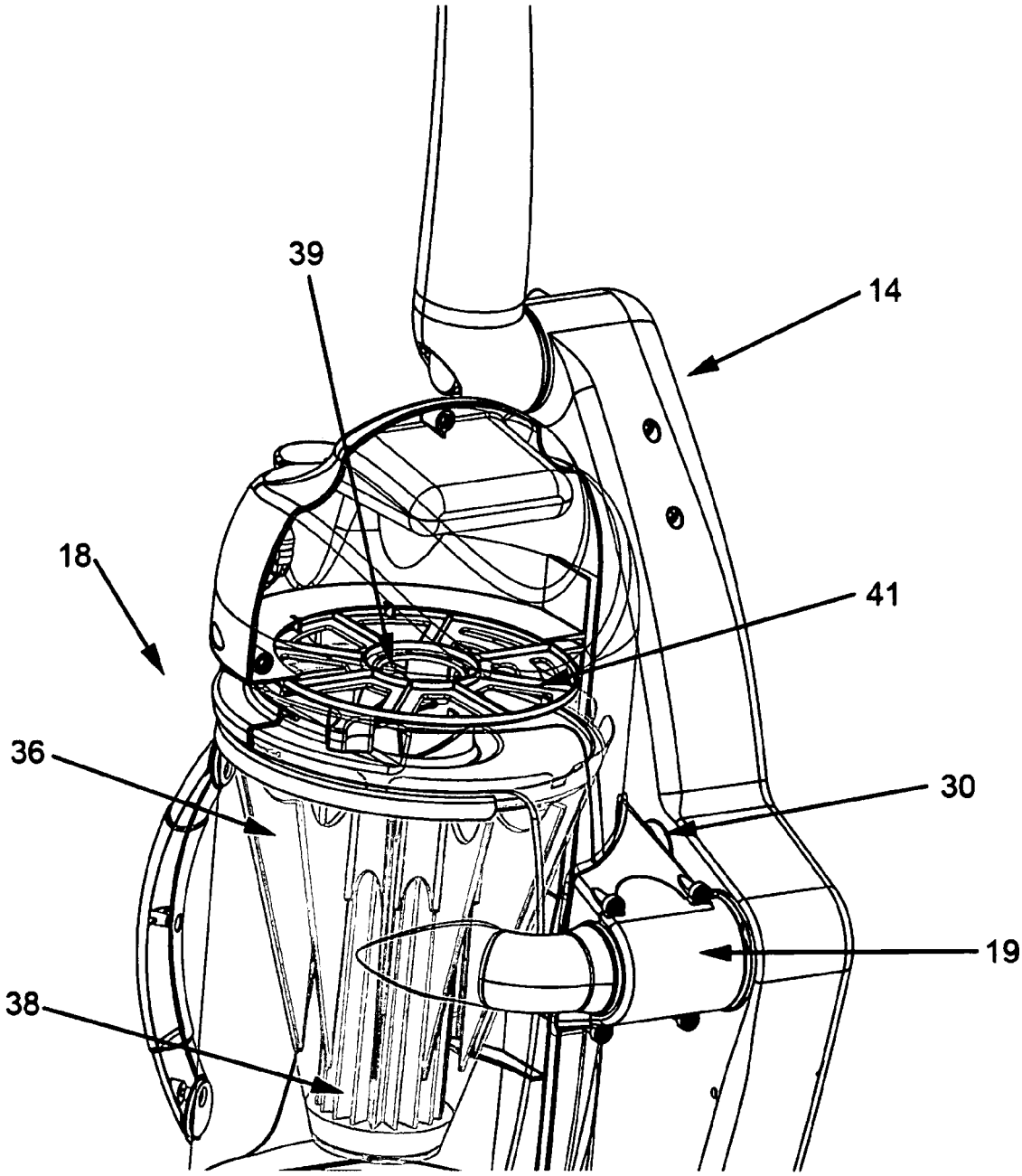
FIG. 9 is a partial detailed perspective view of the top portion of the cyclonic assembly, wherein the cyclonic portion is pivotally affixed to the frame portion of the vacuum.

The top half of the cyclonic assembly 18 is shown in FIG. 9, wherein a disposable, inverted, truncated cone 36 is positioned in a dirt cup 38 of the vacuum 10. A pleated filter 39 (showing the topmost portion only) travels across the length of the cone 36 at its center. Larger particles are first separated from the air stream that travels around the exterior of the cone 36. These particles fall to the bottom of the dirt cup 38. The pleated filter then filters the smaller particles on the interior of the cone 36. A spacer 41 is placed inside the cone 36 so that the cone 36 and the pleated filter can both maintain a secure position until they are accessed. The suction intake hose 30 forms along the internal portion of the wall of the cyclonic assembly 18 to carry air to the cone 36. A hose that is truncated at a sharp 90° can increase the number of clogs in the hose or decrease the air flow. Therefore, the airstream in the present invention travels a gradual 90° from the suction intake hose 30 to the cyclonic assembly 18.

Figure 10:
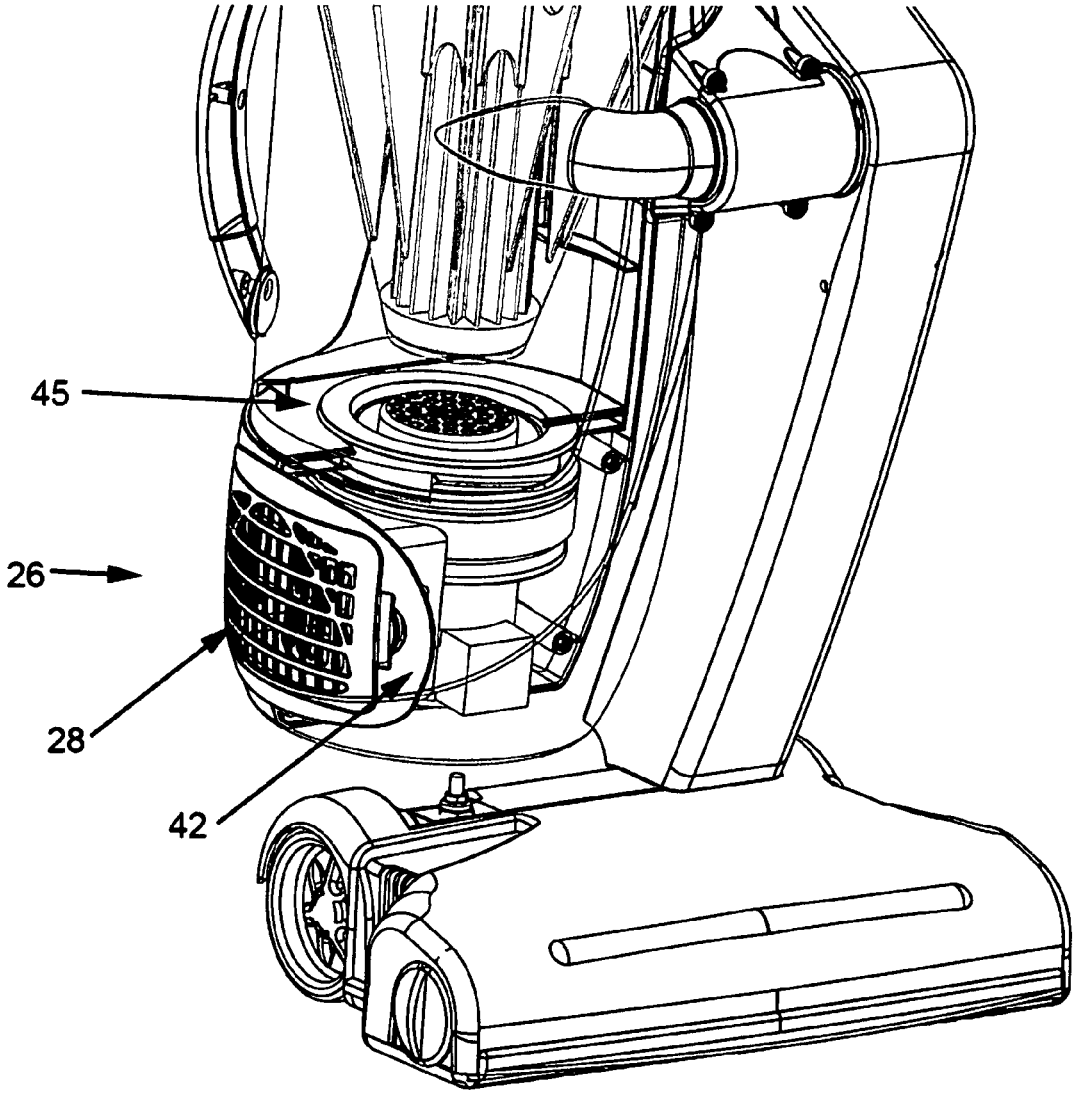
FIG. 10 is a partial detailed perspective view of the bottom portion of the cyclonic assembly.

The bottom half of the cyclonic assembly 18 is shown in FIG. 10. A filter cage 26 provides a means for the air to be discharged from the vacuum cleaner 10. It is envisioned that a "high efficiency particulate air filter" or HEPA filter (as defined by the United States Department of Energy) or another high efficiency filter can be placed within the filter cage 26 to ensure that the airstream is filtered one last time before it is discharged. The filter can be replaced by accessing the interior of the filter cage 26 through the gate 28 door. A push lock 42 releases the gate 26 so that a user is provided access to the interior of the filter cage 26 to removably change the filter. The motor 45 is housed at the bottom portion of the cyclonic assembly 18 behind the filter cage 26. Because the air flowing through the motor is twice filtered, there is no risk of any large objects jamming the motor blades and, as such, there is no risk that a jam will result in decreases in the suction or in the efficiency of the vacuum 10. Another advantage to the motor's placement is that a person will not have to expend additional effort pushing and pulling the weight of a motor housed on the top portion when vacuuming.

Figure 11:
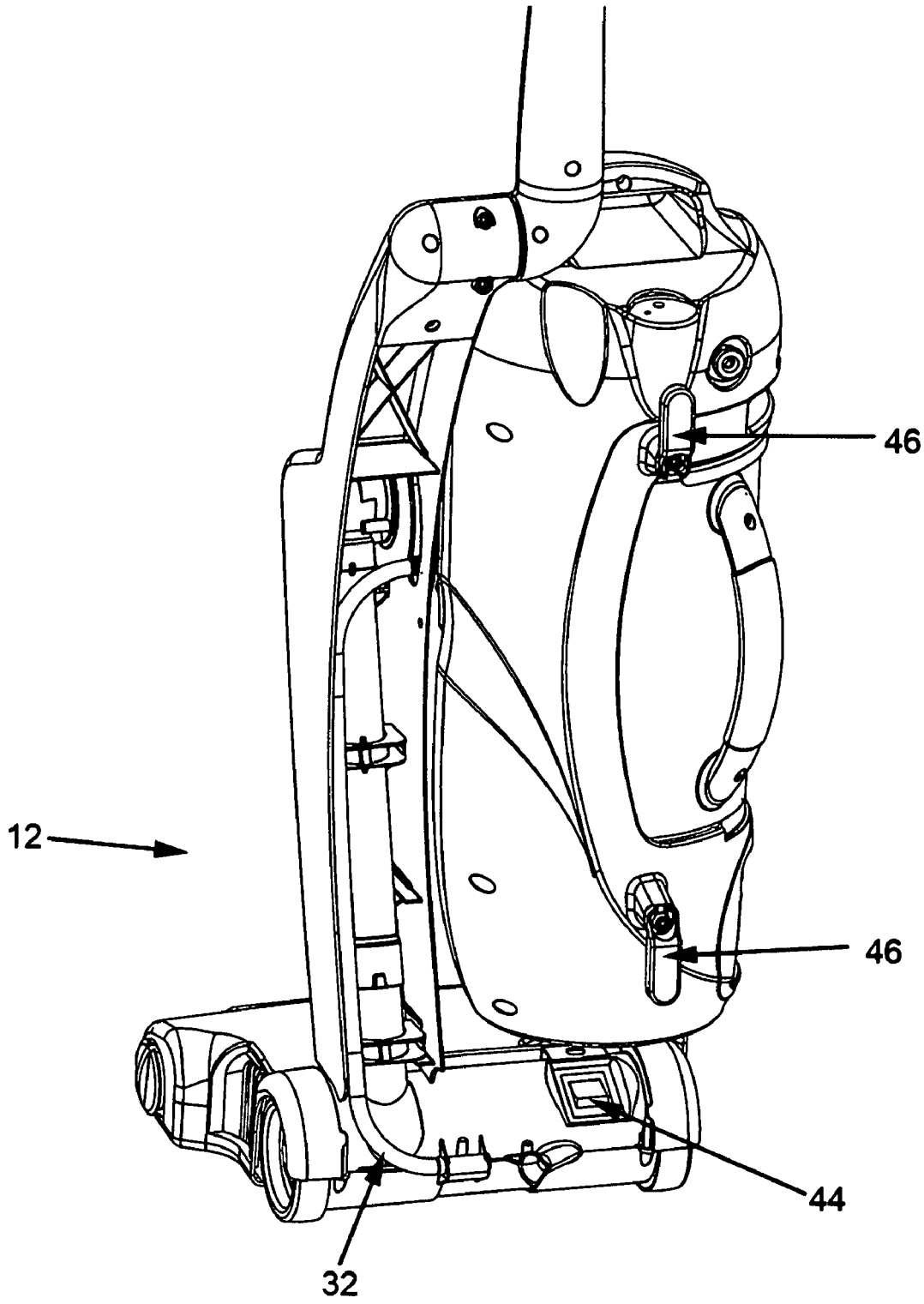
FIG. 11 is an partial detailed perspective view of the rear portion of the vacuum, wherein the hose that carries the particles from the floor to the cyclonic dirt assembly is shown; and, FIG. 12 is a partial exploded perspective view of the power brush portion of the vacuum, wherein the components are shown.

The bottom half of the rear portion of the vacuum cleaner 10 is shown in FIG. 11, wherein an on/off switch 44 is provided on the power brush portion 12. The on/off switch 44 is shown as a rocker type switch, but can be similar to any conventional switching means as used in otherwise conventional vacuums. The vacuum cleaner 10 is provided power by means of an electric power cord 32 that extends to a nearby outlet (not shown). The power cord 32 wraps around a cord reel 46 when the vacuum is not being used. Similarly, a recess 48 at the top of the cyclonic assembly 18, as best shown in FIGS. 1-4 and 6, can receive a hose attachment (not shown) for the vacuuming of staircases, shelves and other hard to reach surfaces as is generally known in the art.

Figure 12:
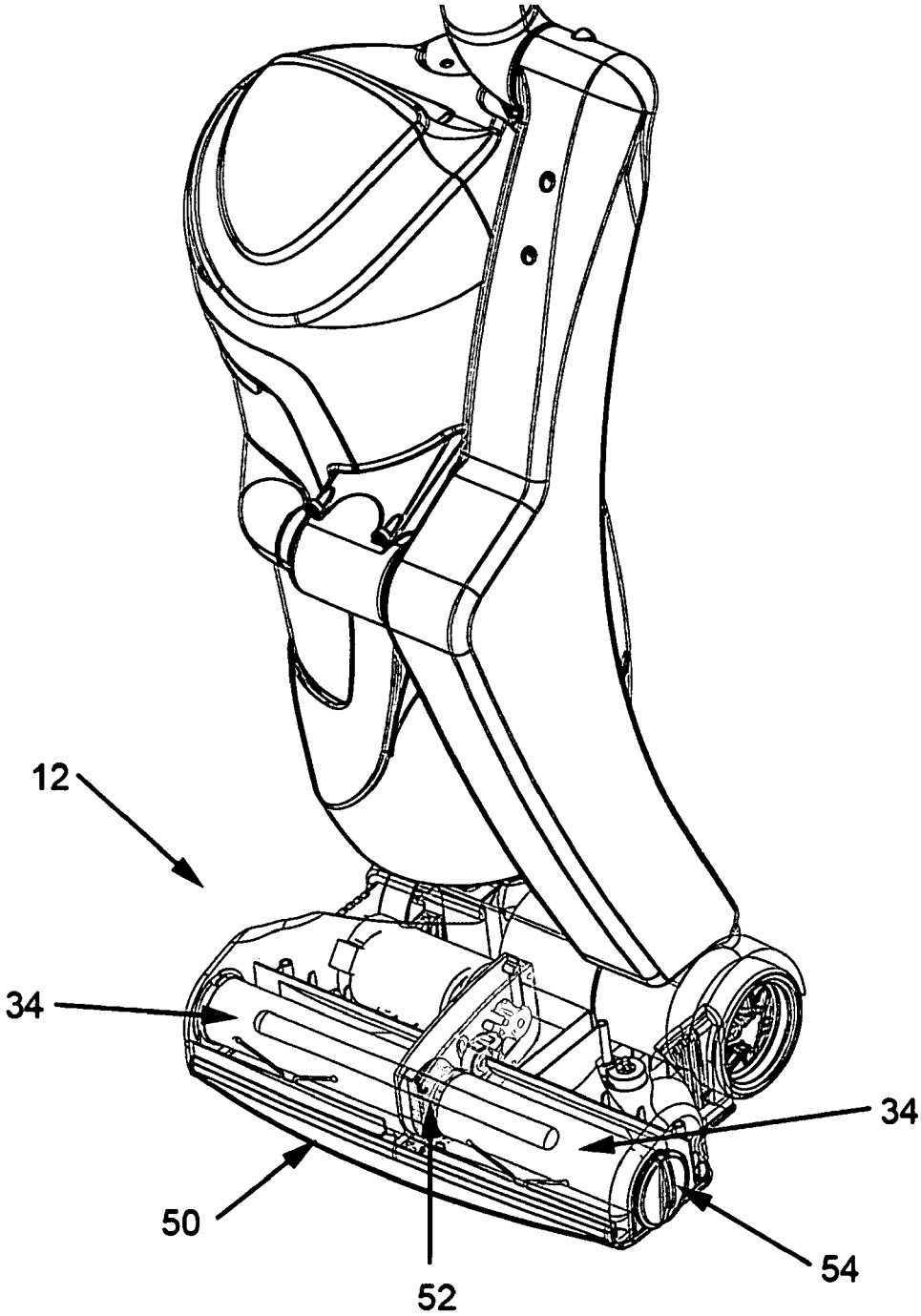

The components of the power brush portion 12 of the vacuum cleaner 10 are shown in FIG. 12 in greater detail. It is similar to other power brushes in appearance, but incorporates features that improve on the functional performance of the present invention. A moving bumper 50 is one feature that improves over other vacuum cleaners available in the art. The bumper 50 slidingly reciprocates, thereby opening a collection slot formed between the bumper 50 and the front portion of the housing of the power foot 12. This slot opens to collect dust at the base boards or the edges of furniture that are typically difficult to reach or inefficiently cleaned. It is envisioned that the moving bumper 50 is either a nylon or a nylon overmolded with a rubber surface, or other materials such that the bumper 50 will not scratch or dent the woods or the furniture it bumps. The timing cog 52 and the belt components are similar to those in other vacuums; however, they engage the improved brushrolls 34. As seen, the brushrolls 34 are split such as to form two separate lateral brushrolls 34. In such a manner, a user can remove each brushroll 34 for easy cleaning by pulling out the entire sleeve. The sleeve can be pulled out by removing the caps 54, held by means of a bayonette fitting, placed on the ends of the sleeves. It is further envisioned that either reusable or disposable brushrolls 34 can be utilized for easier and less costly maintenance.

Other vacuums do not evenly collect dust when they are pushed back and forth from vertical to horizontal positions. The present invention alleviates this inefficiency by providing a cyclonic portion that maintains a vertical position. This design accomplishes an even-cleaning over the entire floor space.

OPERATION OF THE PREFERRED EMBODIMENT

The preferred embodiment of the vertical cyclonic vacuum of the present invention operates similar to other upright vacuum cleaners except that its design provides for greater efficiency and a more thorough cleaning. This is accomplished by means of a cyclonic body portion that is pivotally attached to the frame so that it can maintain a vertical position when the vacuum is pushed forward and pulled backward in the motions common to vacuuming a floor space. A filter assembly working in conjunction with the cyclonic separation process ensures a higher efficiency. The preferred embodiment comprises a cyclonic assembly that separates large particles by means of a cyclonic separation process, a pleated filter that filters smaller particles and a HEPA filter that filters the remaining minute particles before the air is discharged.

A person can utilize the vertical cyclonic vacuum similar to other upright cleaners to clean a floor space. The power brush will vacuum any open floor space or it will reach approximately 1.5 feet under tables and other furniture. When the visible dirt cup or container appears full, a person can access the dirt collection cup to empty it. Similarly, the disposable cone and the filters can all be inexpensively replaced when their uses are maximized.

The foregoing descriptions of specific embodiments of the present invention have been presented for purposes of illustration and description only. They are not intended to be exhaustive or to limit the invention to the precise forms disclosed and obviously, many modifications and variations are possible in light of the above teaching. The embodiments were chosen and described in order to best explain the principles of the invention and its practical application, to thereby enable others skilled in the art to best utilize the invention and its various embodiments with various modifications as are suited to the particular use contemplated. It is intended that the scope of the invention be defined by the Claims appended hereto and their equivalents. Therefore, the scope of the invention is to be limited only by the following claims.

Having thus described the invention, what is claimed as new and desired and to be secured by Letters Patent is as follows:

1. A cyclonic vacuum cleaner comprising:

a frame having an upper end opposite a lower end;

a handle formed by or attached to said upper end;

a power brush portion articulatingly attached at said lower end;

a cyclonic assembly portion in fluid communication with said power brush portion and pivotally suspended to said frame;

said cyclonic assembly portion including;

a vertically elongated assembly body supporting a motor at said lower end;

a radially entering cyclonic intake in fluid communication with said motor;

at least a first filtering means for separating relatively large particles from a cyclonically entering intake airstream;

at least a second filtering means for filtering said intake airstream after passing through said first filtering means;

a filter cage for containing and supporting said at least first filtering means and at least second filtering means; and, wherein said cyclonic assembly maintains a vertical position upon articulation of said handle or said frame.

2. The cyclonic vacuum cleaner of claim 1, wherein said filter cage is removable from and replaceable within said cyclonic assembly portion.

3. The cyclonic vacuum cleaner of claim 2, further comprising at least a third filtering means after a discharge of said filter cage.

4. The cyclonic vacuum cleaner of claim 3, further comprising a HEPA filter means at a discharge of said motor.

5. The cyclonic vacuum cleaner of claim 1, wherein said cyclonic assembly is further balanced on said frame such as to balance the distribution of the weight of said cyclonic assembly portion when said vacuum is in use and to provide for a greater pivot range of said handle.

6. The cyclonic vacuum cleaner of claim 1, wherein said filter cage forms a cyclonic separation assembly comprising:

a dirt cup;

a disposable, inverted, truncated cone positioned in said dirt cup;

a pleated filter that travels across the length of said cone; and a spacer placed inside said cone so that said cone and said pleated filter both maintain a secure position during repeated uses.

7. The cyclonic vacuum cleaner of claim 1, wherein the power brush portion comprises:

a motor housed at a bottom of said cyclonic assembly portion;

an electric power cord that extends to a nearby outlet; and an on/off switch positioned on a top of said power brush portion.

8. The cyclonic vacuum cleaner of claim 7, wherein said power brush portion comprises a moving bumper that opens to collect dust at the base boards or the edges of furniture that are difficult to reach.

9. The cyclonic vacuum cleaner of claim 7, wherein said power brush portion further comprises a plurality of easily accessible and removable brushrolls for cleaning and maintenance purposes.

10. The cyclonic vacuum cleaner of claim 9, wherein said brushrolls can be removed when caps at outside ends of said brushrolls are displaced.

11. The cyclonic vacuum cleaner of claim 1, wherein said power brush portion further comprises:

a power foot housing; and a reciprocating bumper;

wherein said bumper slidingly reciprocates, thereby opening a collection slot formed between said bumper and a front portion of said housing of the power foot.

* * * * *